United States Patent [19]

Sarda

[11] 4,414,913

[45] Nov. 15, 1983

[54] THERMO-ENGRAVING MACHINE FOR PRINTING IN RELIEF

[76] Inventor: Jean L. Sarda, 25 Rue Pradier, 75019 Paris, France

[21] Appl. No.: 283,515

[22] Filed: Jul. 15, 1981

[30] Foreign Application Priority Data

Jul. 18, 1980 [EP] European Pat. Off. ..... 80401072-6

[51] Int. Cl.[3] ..... B05C 11/02; B05C 19/00

[52] U.S. Cl. ..... 118/46; 118/50; 118/57; 118/67; 118/69; 118/70; 118/312; 118/412; 118/415; 118/643

[58] Field of Search ..... 118/66, 67, 69, 653, 118/643, 642, 46, 57, 70, 415, 412, 50, 312, 63

[56] References Cited

U.S. PATENT DOCUMENTS

| | | | |
|---|---|---|---|
| 1,358,614 | 11/1920 | Boecler | 118/67 |
| 2,603,180 | 7/1952 | Berndt | 118/46 |
| 2,674,809 | 4/1954 | Meienhofer | 118/642 X |
| 2,695,005 | 11/1954 | Lewin et al. | 118/415 X |
| 2,757,635 | 8/1956 | Lipsius | 118/312 |
| 3,012,901 | 12/1961 | Reese | 118/57 X |
| 3,021,817 | 2/1962 | Limberger | 118/415 X |
| 3,257,226 | 6/1966 | Thwaites | 118/69 X |
| 4,327,665 | 5/1982 | Arrasmith | 118/642 X |

*Primary Examiner*—John P. McIntosh
*Attorney, Agent, or Firm*—James E. Bradley

[57] ABSTRACT

A thermo-engraving machine has safety, energy conserving and convenience features. The thermo-engraving machine receives a freshly printed sheet, passes it through a device for depositing powder. It heats the powder to cause the powder to melt, then cools the sheet to create raised printed material. The deposition device in one case is a tank with a vertical partition that provides separate containers for powders of different types. The other deposition device is a cyclone type that is pivotal to allow easy cleaning and has toothed wheels in its suction manifold to retain the sheets. The oven has sidewalls that will laterally move to vary the width of the oven. Heater elements in the oven can be selectively turned off for smaller widths. The oven is held by a latch that releases the oven to spring upward should electricity be cut off to the solenoid that holds the latch in position. The cooling conveyor curves around from the back of the oven and leads to the front of the machine, preferably over the top of the oven. The cooling conveyor has a conveyor belt assembly and positive and negative plenums on its sides to retain the sheets in connection with the conveyor belt assembly and cool them at the same time.

39 Claims, 17 Drawing Figures

FIG. 10
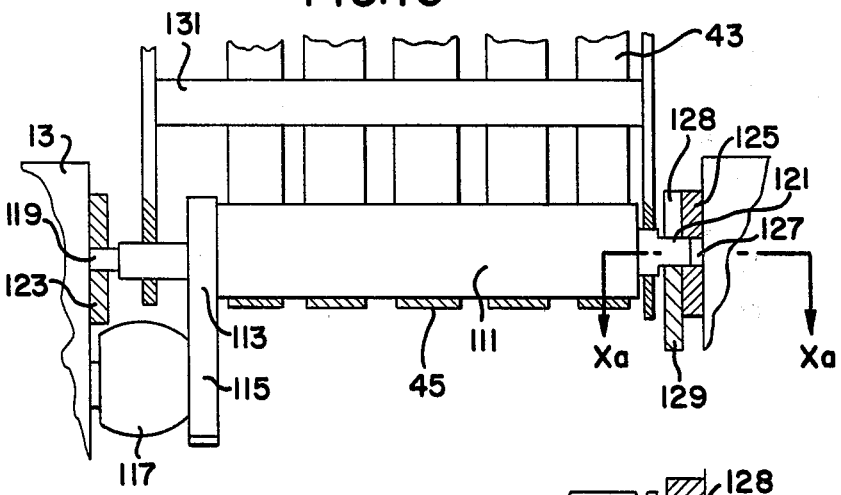
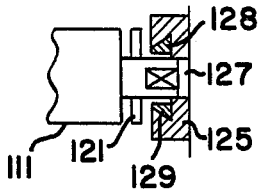
FIG. 10a
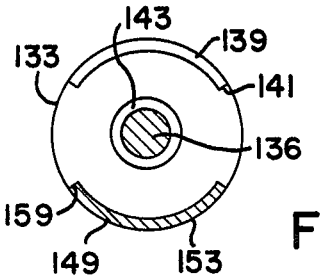
FIG. 11a
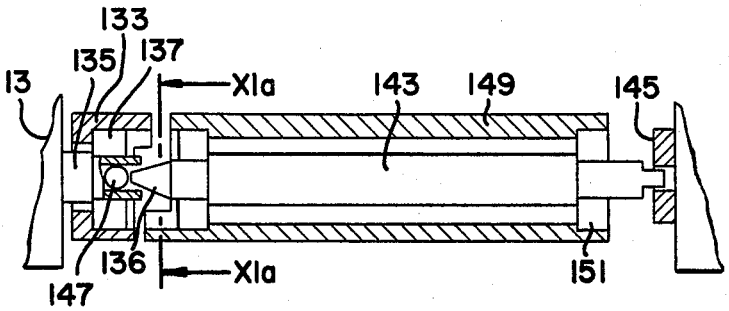
FIG. 11

THERMO-ENGRAVING MACHINE FOR PRINTING IN RELIEF

BACKGROUND OF THE INVENTION

The present invention relates to thermo-engraving machines for printing in relief.

Thermo-engraving or typography in relief is a known process, which makes it possible to obtain from typographic printing, offset or the like, an impression in relief which is an imitation of copper plate printing or stamping.

In the known process, a freshly-printed sheet of paper is dusted or deposited with a powder having the property of melting under heat, and after cooling, forming a film in relief. Only the moist ink retains the powder, and the excess is continuously recovered. After the printed material is deposited with powder, then cleaned of excess, and printed material passes under a tunnel oven for heating. At the outlet of the oven, a jet of cool air cools the printed material and instantaneously solidifies the viscous film in relief so as to prevent the printed material from sticking together.

One powder used provides a glossy or mat finish and is transparent to preserve the tints of the printing colors. On the other hand, irrespective of the printing color, pigmented powders will give a relief corresponding to their pigment. The granule size of the powder employed determines the thickness of the film in relief. The coarser the powder granules, the greater the relief.

The prior art machines limit the possibilities of this process because of several inadequacies and defects. One disadvantage is that the tunnel ovens of these machines always operate at the full width or format, and in the majority of cases, the printed sheets to be treated are of varying widths. As a result, it is common practice to pass printed sheets of 10 cm (centimeters) in width into an oven that would permit the passage of sheets of 35 cm or more. This results in a disproportionate and useless waste of heat and powder.

Also, these machines only work with a single size of powder granules at the same time. Heavy printing characters may necessitate a coarse powder to give a relief of sufficient thickness, while on the contrary, thin characters may require fine powders in order to preserve their fineness in definition. Furthermore, certain portions of the printed text may be desired to be without relief, while others are desired to be in relief or of one or more different colors. These treatments require several passes through the machine, which greatly increases the costs of the treatment.

In the case of packing paper, wallpapers or labels having relief printing, it would be an advantage if the film forming the relief possessed a certain mechanical strength, which is not at present the case. The resins employed are usually polyamides with a low molecular weight, which are not subjected to any secondary action capable of improving their strengths.

Another disadvantage is the floor space taken up by these machines. Because the printing machines normally work at a high output, on the order of 4,000 to 10,000 copies per hour, an adequate length of tunnel ovens and cooling conveyors is required, especially when treating cards of substantial thickness.

These machines do not generally have automatic control of all of their adjustments in respect to the formats, paper weight and frequency of the successive sheets to be treated. Their users are obligated to regulate separately, often in an arbitrary manner, the control such as the speed travel of the conveyors and the temperature of the ovens.

In one type of machine, powder is deposited by gravity and the surplus powder is obtained by suction through a cyclone device. Rotating circular knives in the suction nozzle prevent the paper from being drawn up into the cyclone device. The contact of the knives or disks on the paper reduces the inlet air at the knife at the point of contact. This may result in traces of powder along the whole length of the paper. This is particularly troublesome in the case of colored powders. This defect also occurs in another form, on the back of the printed sheet. The powder conveyor is in fact in contact with the whole surface of the sheet, and has in spite of the suction, a tendency to fail to recover all of the granules of powder on the conveyor, whatever precautions may be taken.

The thermo-engraving machines necessitate frequent cleaning to remain in correct operation, since they deal with large quantities of powder per hour, of which only a small portion remains with the printed material. Cleaning operations are long and difficult at the present time because the components are not readily accessible and removable. In the case of mechanical breakdown or accident, these machines require a long and difficult dismantling operations, which result in loss of time.

During its passage through the interior of the oven, the paper is severely dehydrated. This results in a loss of firmness, which is recovered only more or less after a long period, depending upon the moisture content of the ambient air.

In the case of an accident, the operator must simultaneously stop the conveyor and the powder device, and must rapidly raise the tunnel oven. Otherwise, the paper stopped underneath is liable to catch on fire at once.

The collection of relief-printed sheets presents problems, since the edge of the sheet received has a tendency to catch on the parts in relief of the preceding sheet.

Another disadvantage is that the tray receptacle on prior art machines is located at one point, while the printing press is located at a fair distance away. This compels the operator of the printing press and thermo-engraving machine to move constantly to and fro while watching the two machines.

SUMMARY OF THE INVENTION

In this invention, a thermo-engraving machine is provided with several novel features to solve these various problems. To conserve energy, a tunnel oven is provided that has means for varying width. The sidewalls of the ovens are slidably mounted so that they can be retracted or extended to match the width of the material being printed. The heater elements can be turned on and off separately to turn off elements not required for small width material. To enable different powders to be used, means are shown for dividing the paths into separate sections. In one embodiment, the deposition means for depositing the powder comprises a tank through which the printed material is drawn. The tank has one or more vertical partitions that are parallel with the path for providing separate containers to hold different powders.

To conserve floor space, the cooling section curves back around from the oven to a point near the entrance of the machine. In the preferred embodiment, the cooling conveyor is comprised of several different conveyor belt sections, mounted end to end, and curving back over the top of the oven. To improve suction of the powder in the cyclone type deposition means, knives or disks with toothed peripheries are used. This reduces the contact of the disk with the material to provide better powder removal.

For maintenance of the machine, the rollers are constructed so as to be easily dismantled. The first roller of the cooling conveyor is driven by a gear on one side, with the other side fitting into a slot. This allows the entire cooling conveyor to be removed without the ned for tools. The other rollers over which the conveyor belts are stretched can also be removed without tools. Preferably, each of the rollers includes a drive member that is rotatably mounted to one side of the machine. A sleeve slips into a slot on the other side of the machine and releasably engages the drive member.

For safety, a release system is provided that automatically raises the oven any time the conveyor is stopped and the oven is hot. In the preferred embodiment, the oven is pivoted at one end and urged upward by a bias means to the open position. A latch, when energized, will hold the oven in the closed position. Deenergizing the latch causes the oven to automatically raise to the open position. For re-hydration, a humidifier is placed in the cooling conveyor. In the preferred embodiment, the humidifier includes a tank of liquid, such as water. A system of rollers rolls a film of liquid onto the cooling conveyor assembly.

BRIEF DESCRIPTION OF THE DRAWINGS

FIG. 10 is a sectional view of one of the rollers of the machine of FIG. 1, taken along the line X—X of FIG. 1.

FIG. 10*a* is a sectional view of the rollers of FIG. 10, taken along the line X*a*—X*a* of FIG. 10.

FIG. 11 is a sectional view of one of the rollers of the machine of FIG. 1, taken along the line XI—XI of FIG. 1.

FIG. 11*a* is a sectional view of the roller of FIG. 11, taken along the line XI*a*—XI*a* of FIG. 11.

DESCRIPTION OF THE PREFERRED EMBODIMENT

Figure 1:
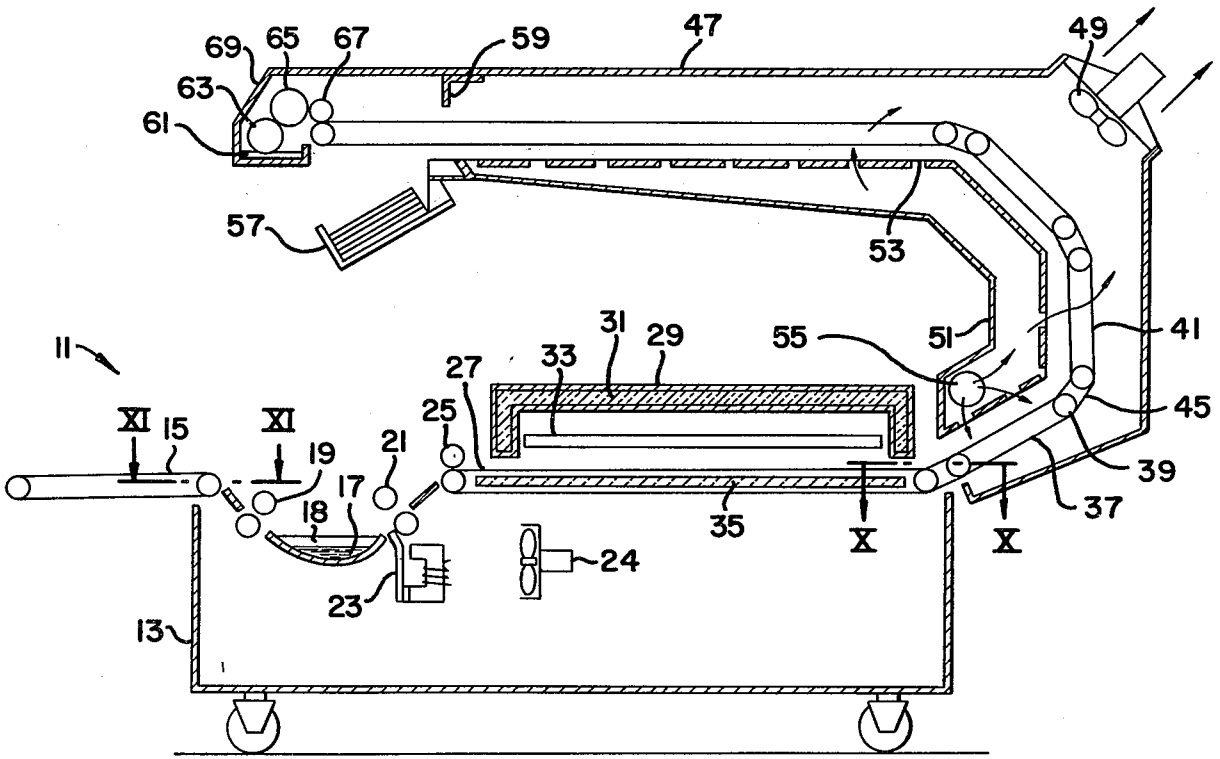
FIG. 1 is a schematic, vertical sectional view of one embodiment of a thermo-engraving machine constructed in accordance with this invention.

Referring to FIG. 1, machine 11 includes a lower housing 13 mounted on wheels. A feed conveyor belt assembly 15 is driven by a motor (not shown), and is mounted to the forward end of housing 13. Feed conveyor assembly 15 continuously receives sheets from a conventional printer (not shown) and advances them into the machine.

A deposition means for depositing heat sensitive powder on the wet ink of the sheets is mounted immediately rearward from feed conveyor assembly 15 and comprises a tank 17 in the embodiment of FIG. 1. Tank 17 is filled to a selected level with conventional heat sensitive powder for thermo-engraving. Nip rollers 19 and 21 at the forward and rearward ends of tank 17 draw the sheet through the tank to deposit powder on the fresh ink.

One or more partitions 18 are vertically mounted in tank 17, to serve as division means for dividing the tank into separate compartments for holding different types of powder. Partitions 18 are parallel with each other and with the direction of travel of feed conveyor 15. Partitions 18 do not extend completely to the bottom of tank 17, providing a small clearance for a sheet to be drawn under the partitions and dusted with different powders simultaneously. Partitions 18 are mounted by suitable means so that they can be moved to vary the widths of their various compartments.

In FIG. 1, the means for removing excess powder from the portions of the sheet not containing wet ink include a vibrating knife or blade 23 that is vibrated by electrical means as indicated. Blade 23 vibrates the sheet, causing the powder not retained by the moist ink to slide down the sheet back into tank 17.

A pair of perforated rollers 25 are located immediately rearward of vibrating blade 23. Rollers 25 have perforations and are connected to a suction fan 24, which draws off any traces of powder that were not removed by the vibrating blade 23. Suction fan 24 deposits the powder in a bag (not shown).

The advancing means for advancing the sheet also includes a metal conveyor 27. Metal conveyor 27 comprises a metallic belt, such as woven links of chain, tautly rotated between two rollers. Heater means for heating the sheets includes a tunnel oven 29 which is mounted above the metal conveyor 27. Tunnel oven 29 includes an insulated housing 31. The heat source comprises a plurality of parallel electrical resistance heater elements 33 mounted in the interior of housing 31. A section of insulation 35 is located between the metal belt of metal conveyor 27. Tunnel oven 29 heats the sheets being conveyed to melt the powder.

Cooling conveyor means for cooling the sheets exiting from the oven 29 include a conveyor belt assembly 37. Conveyor belt assembly 37 is made up of several conveyor belt sections mounted end to end and driven. The sections are formed in the general configuration of a "J", curving upward from the exit of oven 29, then proceeding back horizontally over the top of oven 29 and terminating directly above the powder tank 17. Each conveyor belt section is made up of a pair of rollers 39 mounted parallel to each other, with a plurality of parallel belts 41 stretched between them. The belts are spaced-apart to define slots 43 (FIG. 10) between the belts for the passage of air. The separate sections of the conveyor belt assembly 37 are driven by means of thin drive belts 45 which are stretched between adjacent rollers of adjacent conveyor belt sections.

A negative plenum housing 47, also in the general shape of a "J", is mounted around the exterior side of conveyor belt assembly 37. The conveyor belt assembly 37 forms the inside wall of the negative plenum 47. A suction fan 49 is mounted to negative plenum 47 to draw air from the negative plenum and discharge it to the atmosphere.

An enclosed housing defining a position plenum 51 is mounted inside the "J" configuration of the conveyor belt assembly 37. Positive plenum 51 is also in the shape of a "J" and has an outside or discharge wall containing a plurality of apertures 53. The discharge wall is closely and uniformly spaced from conveyor belt assembly 37, defining a clearance for the passage of sheets that frictionally engage the cooling conveyor assembly 37. Positive plenum 51 has means for discharging air through apertures 51, through the slots 43 (FIG. 10) of conveyor belt assembly 37, to be drawn out of the negative plenum 47 by means of fan 49, as indicated by the arrows. The discharge means for the positive plenum 51 could be a separate fan, or it could be a port 55 that is supplied with part of the discharge air of fan 49 by manifolds (not shown). Preferably, air is actually blown through the slots 53 in the positive plenum 51, and not just drawn by the suction of suction fan 49.

The combination of the suction in the negative plenum 47, plus the positive air pressure from the positive plenum 51 serve as plenum means to discharge air through conveyor assembly 37 to cool the sheets being conveyed along conveyor assembly 37 and cause them to adhere to the belts 41. This allows the printed sheets to pass from a horizontal position on top of metal conveyor 27 through an inclined position as the beginning of conveyor belt assembly 37, a vertical position at the base of the "J" of conveyor belt assembly 37, and finally a horizontal position on the lower side of the horizontal portion or leg of the "J" of conveyor belt assembly 37.

A tray 57 depends from the free, cantilevered end of positive plenum 51 for receiving the cooled printed sheets. A baffle 59 within the negative plenum 47 is located at the entrance of tray 57. Baffle 59 reduces the suction being drawn on the sheets at that point, allowing them to drop into tray 57. Because the sheet is inverted as it proceeds along the cooling conveyor belt assembly 37, the printed material will be on the lower side. The following sheets will thus slide onto the smooth backside of each printed document. The smooth backside reduces the tendency to stick that would otherwise occur if the raised printed material were on the upper side of a sheet.

Means to add humidity to the document sheets in the cooling conveyor means is located at the free or cantilevered end of the negative plenum 47. The humidification means preferably includes a tank 61 for holding a liquid, normally water. A wetting roller 63 is rotated by roller means within the liquid of tank 61. The roller means includes a drying roller 65 that is rotated by wetting roller 67, which is rotated by the final roller of the horizontal section of conveyor belt 37. Rollers 63, 65 and 67 pick up a film of water, which is transmitted to the belts of the horizontal section of conveyor belt assembly 37 for adding humidity. A transparent access door 69 enables additional liquid to be introduced into tank 61 and provides means for the operator to determine whether or not additional water is needed.

Figure 2:
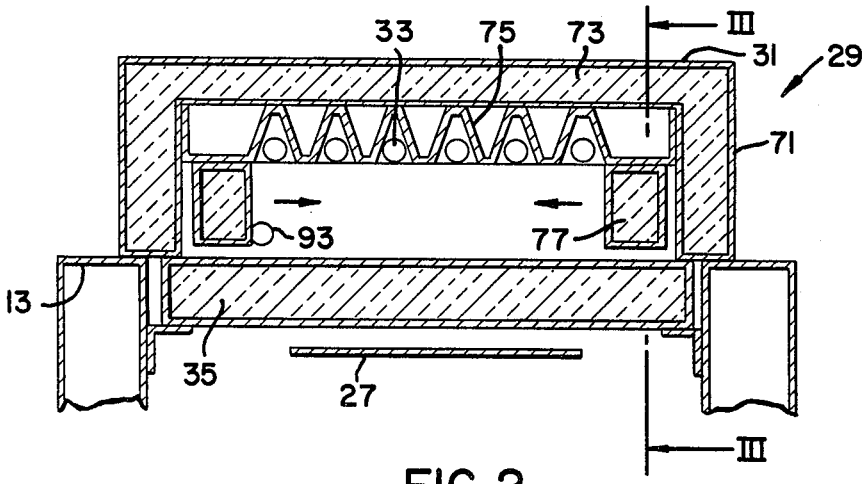
FIG. 2 is a sectional view of the machine of FIG. 1, taken along the line II—II of FIG. 1.

Certain of the components of machine 11 will now be described in more detail. Referring to FIG. 2, housing 31 of tunnel oven 29 is a generally rectangular heat barrier with a top, two longitudinal sides 71 and an entrance and an exit for material to pass through on the metal conveyor 27. The sides 71 and top of housing 31 are double walled and contain insulation material 73. A corrugated ceiling 75 is mounted to the inside of the top of housing 31. Ceiling 75 has longitudinal, parallel grooves or corrugations formed in it. An electrical resistance heater element 33 is located within each of the grooves of ceiling 75.

Figure 3:
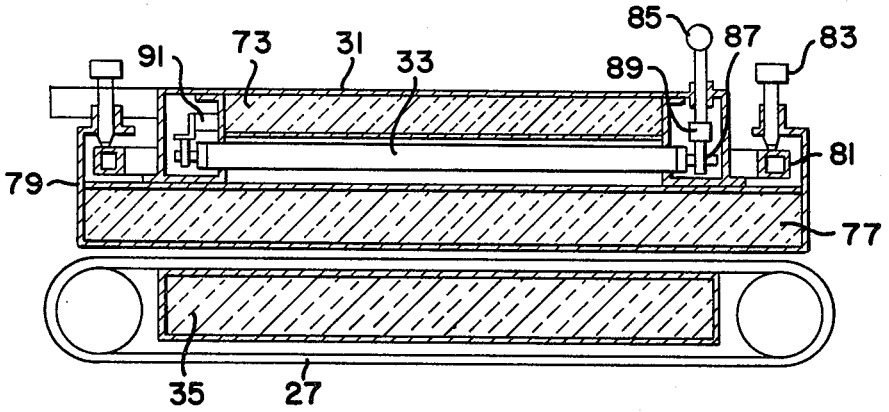
FIG. 3 is a sectional view of the machine of FIG. 1, taken along the line III—III of FIG. 2.

A pair of sidewalls 77 depend downwardly from the ceiling 75 in the interior of housing 31 and on the inside of sides 71. Each partition or sidewall 77 is double walled and of a length such that it will be closely spaced above metal conveyor 27, but not in contact. Sidewalls 77 are movable inwardly and outwardly, as indicated by the arrows shown in FIG. 2. Ceiling 75 and the innersides of the two sidewalls 77 define a heat zone of width that can be varied. FIG. 3 discloses how the sidewalls will slide laterally inward and outward. Each sidewall 77 has an upwardly extending flange 79 with a horizontal portion that overhangs a brace 81. Braces 81 extend transversely across housing 31 at the entrance and exit of the housing, and comprise rectangular tubular members. A screw 83 can be tightened to cause the top of the sidewalls 77 to bear tightly against ceiling 75 to lock the sidewalls 77 in the desired position.

To reduce energy consumption when the width of the heat zone is reduced by moving the sidewalls 77 toward each other, a switch means is provided for selectively cutting off the electrical energy to selected heater elements 33. Preferably, each heater element 33 is separately controlled so that any heater element 33 may be turned off while the other elements are turned on. This could be an electrical switch, or as shown in FIG. 3, a mechanical switch 85. Mechanical switch 85 has a spring clip 87 that forms electrical contact with the end of the heater element 33. An insulated rod 89 extends upwardly through the top of housing 31, and is biased upward by a coil spring. Moving rod 89 upward removes the electrical energy from heater element 33. The spring will hold the switch 85 in the upper position. When in the closed position, clip 87 will form a tight contact about the contact of heater element 33 to hold it in the closed position. A clip assembly 91 for completing the electrical circuit is located on the other end of heater element 33.

Referring to FIG. 2, an infrared probe 93 is located inside oven 29. Infrared probe 93 detects the infrared content emitted by the oven, and transmits this data to a heat regulator. Circuit means (not shown) will cause the motor driving the metal conveyor 27 to speed up or slow down as the temperature varies. When the temperature of the oven falls, the motor slows down for the period of time required for the heat regulator to compensate for this cooling and vice-versa.

Figure 4:
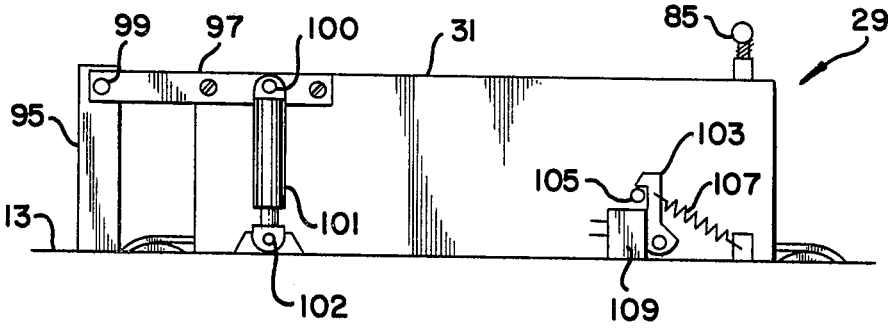
FIG. 4 is a side elevational view of the tunnel oven of the machine of FIG. 1.
Figure 5:
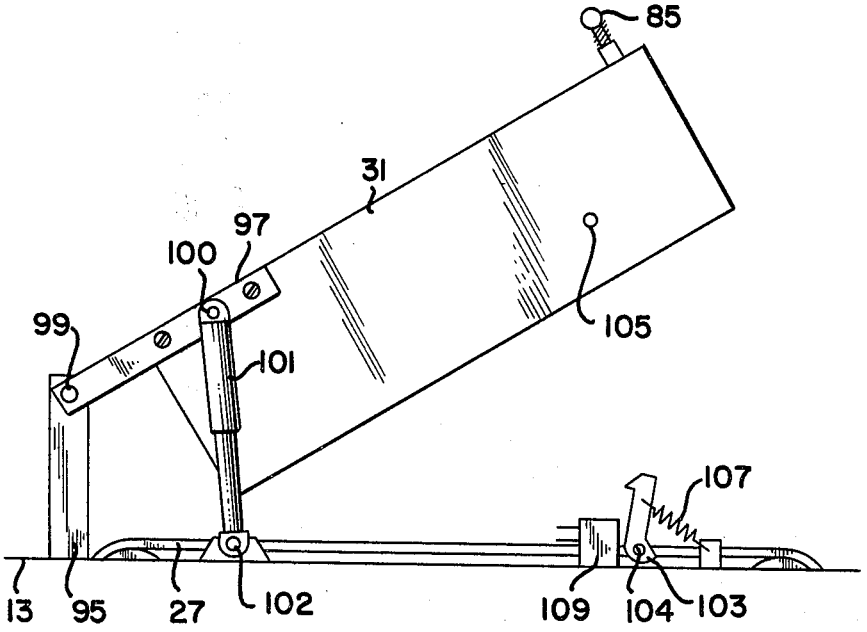
FIG. 5 is a side elevational view of the tunnel oven of FIG. 4, shown in the open position.

FIGS. 4 and 5 disclose safety release means for automatically raising oven 29 should the metal conveyor 27 be stopped, and for preventing the oven 29 from being closed unless the conveyor 27 is running. The housing 31 is pivotally secured to the machine housing 13 by means of two braces 95 and 97 connected together by a pivotal pin 99. This allows oven 29 to move between a closed position shown in FIG. 3 to a raised position shown in FIG. 5 in which it pivots upwardly. The exit end of housing 31 is spaced forwardly a certain distance from pin 99 so that the lower edge at the exit end will swing upward above metal conveyor 27 in the open position. A bias means for urging the housing 31 to the open position comprises a pneumatic cylinder 101 connected between housing 13 and brace 97. Pneumatic cylinder 101 compresses air within it to serve as a spring to exert an upward force. Pneumatic cylinder 101 is pivotally mounted to housing 13 and brace 97 by pins 100 and 102.

Latch means for holding the housing 31 in the closed position includes a latch 103 pivotally mounted to housing 13 by a pin 104. Latch 103 has an upper end with a hook portion that is adapted to engage a pin 105 secured to the side of housing 31. Bias means comprising a coil spring 107 urges latch 103 to the open position shown in FIG. 5. An electrically actuated solenoid 109, when supplied with electrical current, will overcome spring 107 and draw the latch 103 to the closed position. Consequently, any time that the electrical current is interrupted, the solenoid 109 will serve as signal means to release latch 103, causing oven housing 31 to spring upward. The open position cools the documents located on the metal conveyor 27, avoiding the possibility of a fire from overheating should the documents remain too long in hot oven 29. Any cessation of power to the machine will release the latch, whether or not the oven 29 is hot. Also, an emergency button (not shown) is located on the control panel of the machine. This button, when depressed, deenergizes solenoid 109 and stops the conveyors 15, 29 and 37. Circuitry will cause solenoid 109 and the conveyors to remain deenergized until a reset is depressed.

The rollers of the various conveyor belts of the machine of FIG. 1 will now be described in more detail. Referring to FIG. 10, the first roller 111 of the cooling conveyor belt assembly 37 is generally cylindrical for receiving the resilient belts 45. A gear 113 is formed on one side of roller 111 for rotation therewith. Gear 113 engages a gear 115, which is driven by a pulley 117. Pulley 117 is rotated by a belt (not shown) which is driven by a motor (not shown). Roller 111 is rotatably mounted on an axle which has two protruding ends 119 and 121. Axial end 119 extends into a circular aperture provided in a plate or bracket 123 secured to the frame of the lower housing 13. A plate or bracket 125 is mounted to the opposite side of frame 13. Bracket 125 has a vertical slot 127 formed in it for receiving axle end 121. A "U" shaped key 129 slides within a slot 128 formed in bracket 125 transverse to slot 127, to serve as a keeper to retain axle end 121 in slot 127. In FIG. 10, key 129 is shown partially withdrawn from its slot 128.

Support arms or conveyor frame members 131 are articulated on the axle ends 119 and 121. Support arms 131 support the conveyor belt assembly 37 and the plenums 47 and 51 (FIG. 1). Withdrawing key 129 enables axle end 121 to be removed from its slot 127. Gear 113 will disengage from gear 115, and axle end 119 will disengage from bracket 123. The entire cooling assembly can thus be lifted from the machine without the need for tools.

Various rollers in the feed convayor 15 and cooling conveyor belt assembly 37 (FIG. 1) are constructed so as to be quickly removable without the need for special tools. Referring to FIG. 11, the roller includes a drive member 133. Drive member 133 has a cylindrical exterior for receiving a drive link, which could be one of the belts 45 (FIG. 1) in the case of rollers in the cooling conveyor assembly 37. Drive member 133 is mounted on an axle 135 by means of bearings 137. Axle 135 is rigidly fixed to housing 13 or to some other portion of the frame of the machine 11. Axle 135 is cantilevered from housing 13 and has a bore 136 facing the other side of housing 13. As shown also in FIG. 11*a*, drive member 133 has an arcuate projecting flange 139 that extends toward the other side of housing 13. Flange 139 extends less than 180 degrees and has drive surfaces 141 on each terminating edge.

Another axle 143 has an end that slips into a vertical slot in a bracket 145 rigidly secured to the other side of housing 13. Axle 143 has a free end 147 that is shaped to fit securely within the bore 136 of axle 135. Free end 147 has a rounded portion formed on the end of a reduced diameter neck, which allows the free end 147 to pivot within the bore 136 of axle 135 when the end of axle 143 is moved out of its slot in bracket 145 to withdraw axle 143.

A tubular metal sleeve 149 is mounted rotatably to axle 143 by means of bearings 151. Sleeve 149 has a smooth cylindrical exterior for receiving the belt of a conveyor assembly such as feed conveyor 15. Sleeve 149 is of considerably greater length than drive member 133 and of the same diameter. Sleeve 149 has a free end that has a flange 153 protruding toward drive member 133. Flange 153 is an arcuate member of length less than 180 degrees, with drive surfaces 159 that are adapted to be contacted by the drive surfaces 141 of drive member 133, as shown in FIG. 11*a*.

In operation, the flanges 139 and 153 serve as engaging means to interlock so that drive member 133 will rotate sleeve 149. Drive member 133 will be rotated by a drive belt from a pulley or from an adjacent drive member 133 if one is nearby. Sleeve 149 will rotate the roller of the conveyor section on the opposite end. Axle 143 is supported in alignment with axle 135 through support means comprising bore 136 and free end 147. To remove the roller, the end of axle 143 is withdrawn from the slot in bracket 145. Then the free end 147 of axle 143 is withdrawn from bore 136. The sleeve 149 and axle 143 can then be slipped free of its conveyor belt or belts.

Figure 6:
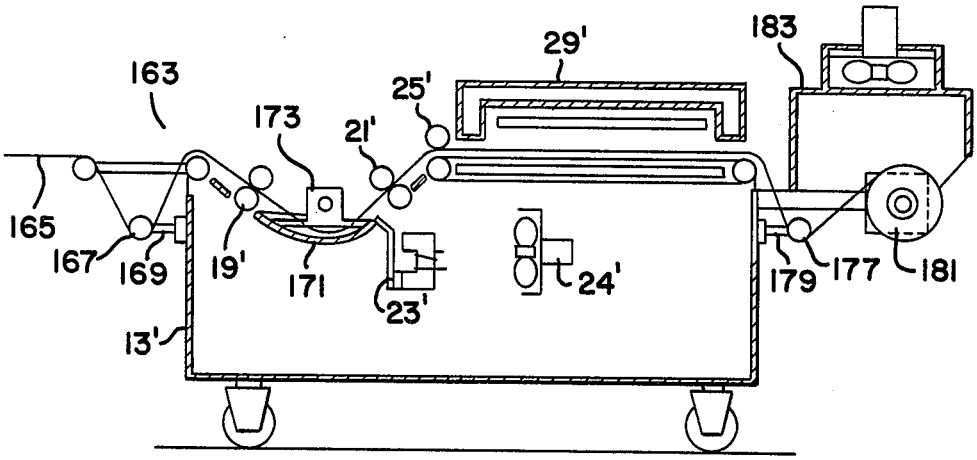
FIG. 6 is a schematic, vertical-sectional view of an alternate embodiment of the machine in FIG. 1.
Figure 7:
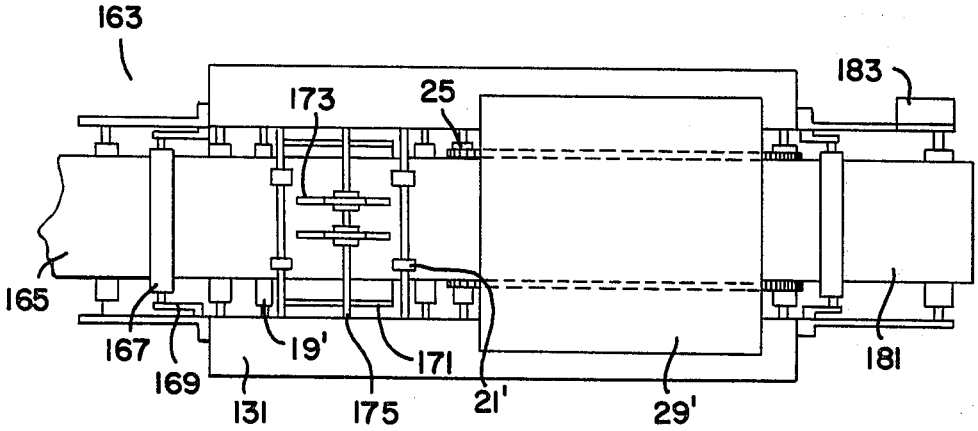
FIG. 7 is a top view of the machine of FIG. 6.

Certain of the alternate embodiments will now be discussed. Referring to FIGS. 6 and 7 components of the machine of FIG. 1 that are identical to the machine of FIG. 1 will be shown with a prime symbol and will not be discussed. The machine 163 of FIG. 6 is constructed for thermo-engraving a roll or web 165 of printed material as it proceeds freshly printed from a printer (not shown). The web proceeds along a path through a roller 167 supported by frame 13' through an oscillating arm 169. The web proceeds through nip rollers 19' and a tank 171 that contains powder. As shown in FIG. 7, tank 171 is divided by two vertical and parallel partitions 173 mounted on a shaft 175. This results in three separate compartments, which can be provided with powders of different pigment and grain size. The partitions are slidable on shaft 175 to vary the width of the compartments. Rollers (not shown) may be located in tank 171 to maintain the web below partitions 173 as it proceeds through the tank. Rollers could also be used in tank 17 of FIG. 1 to facilitate moving sheets of short length through the powder tank.

As in FIG. 1, the web 165 proceeds past a vibrating knife 23', through nip rollers 21' and suction rollers 25'. Suction fan 24' withdraws traces of powder remaining after vibrating knife 23'. Oven 29' melts the powder. The web 165 then proceeds through a roller 177 mounted by an oscillating arm 179 to frame 13'. Web 165 is wound onto a takeup roll 181. A cooling fan 183 discharges air on the web 165 subsequent to oven 29'.

To improve mechanical properties to the film in relief, ultra-violet lamps (not shown) may be interposed between oven 29' and cooling unit 183. This source of ultra-violet radiation polymerizes the film in relief and renders it infusible. The resins employed belong to the vyrilic and acrylic groups of resins. The molecular conversion, which confers a certain infusibility to the resin, is obtained by mineral or organic adjuvants and catalysts under the action of internal reactions of short ultra-violet wave length or by laser.

Figure 8:
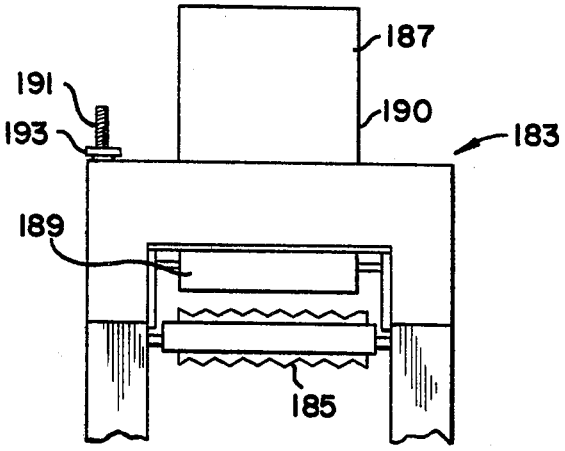
FIG. 8 is a front view of a cyclone type powder device that could be used with either the embodiment of FIG. 1 or FIG. 6.
Figure 9:
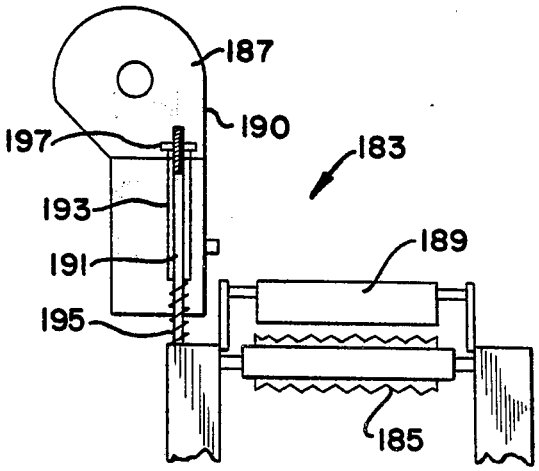
FIG. 9 is a front view of the cyclone device of FIG. 8 shown pivoted to the open position.

FIGS. 8 and 9 disclose an alternate deposition means for depositing powders in lieu of tank 17 of FIG. 1 and the tank 171 of FIG. 6. The powdering device 183 of FIGS. 8 and 9 is a conventional cyclone type that has feed means for dispensing a metered flow of powder by gravity down onto a conveyor belt assembly 185. A suction fan 187 draws the excess powder that has not adhered to the moist ink up through a suction manifold or nozzle 189. Suction nozzle 189 is spaced a short distance behind the point where the powder is dropped, and mounted to the lower housing of the machine a short distance above conveyor belt 185. Suction nozzle 189 extends the full length of conveyor belt 185.

The feed means and suction fan 187 are located in a housing 190. For cleaning purposes, the housing 190 can be pivoted away from conveyor belt 185 and suction nozzle 189. The pivotal movement can be accomplished in various manners. In FIGS. 8 and 9, a vertical rod 191 is mounted to the lower housing of the machine. Rod 191 receives one side of the housing 190, this side having a sleeve 193 that slides over rod 191. A coil spring 195 urges the housing 190 upward. A nut 197 engages threads on the top of rod 191 to tighten the unit into a lower position.

During operation, housing 190 will be placed over the path defined by conveyor belt 185. A manifold (not shown) within housing 190 will be in air tight engagement with suction nozzle 189. To remove for cleaning, nut 193 is loosened. Spring 195 will urge the housing upward. Once housing 190 clears nozzle 189, it will be pivoted or rotated about rod 191 until it is out of the path as shown in FIG. 9.

Figure 13:
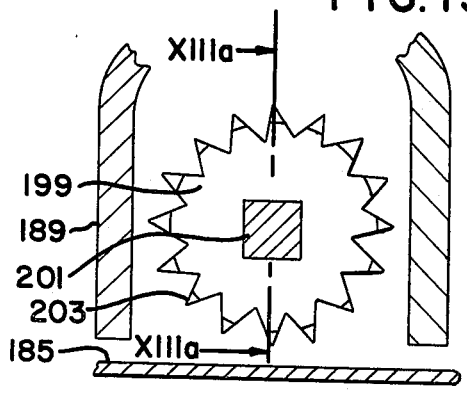
FIG. 13 is a partial sectional view of the cyclone device of FIG. 8, taken along the line XIII—XIII of FIG. 8, and illustrating the toothed disks.
Figure 13A:
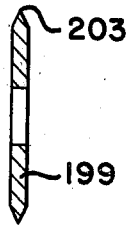
FIG. 13*a* is a sectional view of the toothed roller of FIG. 13, taken along the line XIII*a*—XIII*a* of FIG. 13.

A second novel feature that may be incorporated in the cyclone unit 183 is shown in FIGS. 13 and 13*a*. Nozzle 189 has located within it a plurality of wheels or disks 199 that are spaced-apart and mounted on a driven shaft 201. Disks 199 are thin metal members that have a circular periphery that is toothed. A plurality of evenly spaced triangular teeth 203 extend completely around the circumference of disk 199. Teeth 203 are formed, as indicated in FIG. 13, to provide a sharp edge for contacting documents drawn along belt 185. This facilitates powder removal.

Figure 12:
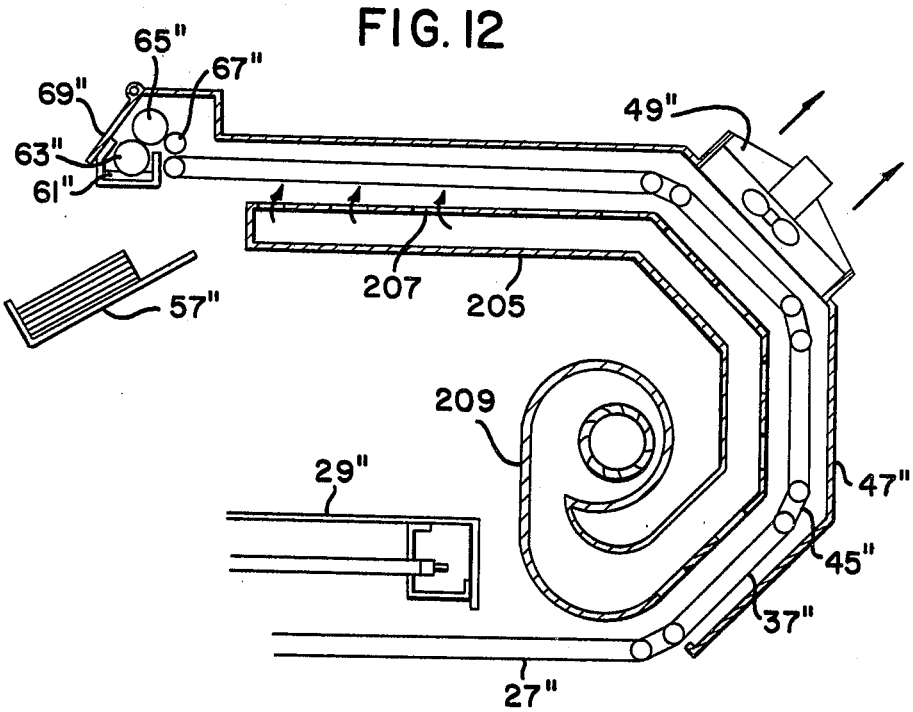
FIG. 12 is a vertical-sectional view illustrating another embodiment of the cooling section of the machine of FIG. 1.

FIG. 12 shows portions of an alternate cooling section for the machine of FIG. 1. Components that are identical to those shown in FIG. 1 will be indicated with a double prime and will not be discussed. The positive plenum 205 of the embodiment of FIG. 12 differs from the positive plenum 51 of FIG. 1. Positive plenum 205 is an enclosed structure with a discharge wall that has a plurality of slots or apertures 207 for discharging against the conveyor belt assembly 37''. Rather than use a single fan, as fan 49 in FIG. 1, a separate blower 209 is connected to positive plenum 205. Blower 209 creates a positive pressure greater than ambient to discharge air through slots 207. At the same time suction fan 49'' creates a negative pressure less than ambient within the negative plenum 47''. Blower 209 and fan 49'' cooperate to cause an air flow through conveyor 37'' to retain the documents in contact with the conveyor and cool them.

Figure 14:
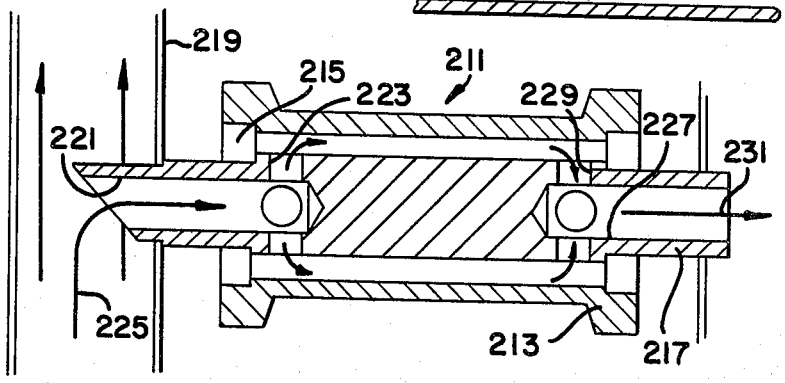
FIG. 14 is a sectional view of a roller that could be used with either machine of FIG. 1 or FIG. 6 and located intermediate the ends of the conveyor that runs below the tunnel oven.

FIG. 14 shows a roller assembly 211 that may be required for very long tunnel ovens 29 (FIG. 1). Roller 211 would be mounted between the ends of the metal conveyor belt 27 (FIG. 1) to support the conveyor belt in the center. To avoid overheating roller 211, the roller has means for cooling. Roller assembly 211 includes a sleeve 213 that is rotatably mounted by bearings 215 to a shaft 217. The inner diameter of sleeve 213 is larger than the diameter of shaft 217, defining an annular clearance. The shaft 217 has one end that extends into a manifold 219, through which coolng air is blown. This end of shaft 217 has a passage 221 which extends inward to radial ports 223 for discharging air in the clearance between shaft 217 and sleeve 213. The entrance to passage 221 is inclined so as to scoop air in as indicated by arrow 225. A discharge passage 227 is located on the opposite end of shaft 217. Discharge passage 227 is in communication with radial ports 229 which receive air blown into the annular clearance from ports 223. Air discharges to the exterior of the machine as indicated by arrow 231.

The invention has significant advantages. For sheets and webs of small width, power is conserved by the use of the variable width heat zone. The printed sheets may be treated simultaneously with one or more types of powder, of different nature or color. The ultra-violet lamps provide a certain infusibility and good mechanical strength. The cooling conveyor, which curves back to the forward end of the machine, effects a substantial reduction in the overall dimensions, particularly the length of the machine. The infrared probe and associated control circuitry automatically control the speed and temperature for format, paper weight and rate of treatment of the sheets.

The toothed disks in the suction manifold avoid, to the maximum extent, traces of the powder on either side of the sheet. The conveyor belt rollers, and the mounting of the first roller of the cooling conveyor allow the machine to be easily disassembled for cleaning and maintenance. Humidity is added by the humidification means mounted in the cooling section. The safety release for the oven automatically raises the oven in case the conveyor stops, to avoid fire.

The upwardly curved cooling conveyor belt inverts the sheets so that when received in the receptacle tray, the edge of the next following sheet only makes contact with the smooth reverse side of the previous sheet. The rearwardly curved conveyor system also places the completed sheets at the forward end of the machine, allowing an operator to operate both a printing machine and the thermo-engraving machine without constant movements back and fourth. In case of very long tunnel ovens, an air cooled roller will support the conveyor belt assembly.

While the invention has been shown in only a few of its forms, it should be apparent to those skilled in the art that it is not so limited but is susceptible to various changes and modifications without departing from the spirit of the invention.

I claim:

1. A thermo-engraving machine, comprising in combination:

deposition means for depositing a heat sensitive powder deposit on wet ink of freshly printed individual sheets;

heater means for heating the sheets to melt the powder deposit, the heater means having an entrance and an exit;

advancing means for continuously advancing the sheets from a printing machine through the heater means; and cooling conveyor means for cooling the sheets exiting from the heater means and returning the sheets to a vicinity near the entrance of the heater means.

2. The machine according to claim 1 wherein the cooling conveyor means extends upwardly from the exit of the heater means and turns back to a receiving tray.

3. A thermo-engraving machine, comprising in combination:

deposition means for depositing a heat sensitive powder deposit on wet ink of a freshly printed sheet;

heater means for heating the sheets to melt the powder deposit, the heater means having an entrance and an exit;

advancing means for continuously advancing the sheets from a printing machine through the heater means; and cooling conveyor means for cooling the sheets exiting from the heater means and returning the sheets to a vicinity near the entrance of the heater means;

the cooling conveyor means extending upwardly from the exit of the heater means and curving back to a generally horizontal section located above the heater means that terminates in a receiving tray located generally above the deposition means.

4. A thermo-engraving machine, comprising in combination:

deposition means for depositing a heat sensitive powder deposit on wet ink of a freshly printed sheet;

heater means for heating the sheets to melt the powder deposit, the heater means having an entrance and an exit;

advancing means for continuously advancing the sheets from a printing machine through the heater means; and cooling conveyor means for cooling the sheets exiting from the heater means and returning the sheets to a vicinity near the entrance of the heater means;

the cooling conveyor means comprising;

a plurality of conveyor belt sections mounted end to end and driven to define a path for the sheets back to the vicinity of the entrance of the heater means; and blower means for passing air transversely through the conveyor belt sections to cause the sheets to frictionally engage the conveyor belt sections for transport along the path.

5. In a thermo-engraving machine of the type having deposition means for depositing a powder on wet ink of a freshly printed sheet, heater means for heating the sheets to melt the powder deposit, advancing means for continuously advancing the sheets from a printing machine through the heater means, an improved cooling conveyor means for cooling the sheets exiting the heater means, comprising in combination:

a driven conveyor belt assembly beginning at the exit of the heater means and turning back to terminate at a sheet tray in the vicinity of the entrance of the machine; and plenum means extending along the length of the conveyor belt assembly for passing air transversely through the conveyor belt assembly to cool the sheets and cause them to engage the conveyor belt assembly.

6. The machine according to claim 5 wherein the plenum means comprises:

a negative plenum mounted on the side of the conveyor belt assembly opposite the side that conveys the sheets, the conveyor belt assembly defining one wall of the negative plenum and having apertures for the passage of air transversely through the conveyor belt assembly; and blower means for moving air through the apertures and passing the air from the negative plenum.

7. The machine according to claim 5 wherein the plenum means comprises:

an enclosed positive plenum having a discharge wall closely spaced from the side of the conveyor belt assembly that carries the sheets and extending substantially the length of the conveyor belt assembly, defining a clearance between the discharge wall and the conveyor belt assembly for the passage of the sheets; and blower means for moving air through a plurality of apertures provided in the discharge wall.

8. The machine according to claim 5 wherein the plenum means comprises:

a positive plenum having a discharge wall closely spaced from the side of the conveyor belt assembly that carries the sheets and extending substantially the length of the conveyor belt assembly, defining a substantially uniform clearance between the discharge wall and the conveyor belt assembly for the passage of the sheets; the discharge wall having a plurality of apertures;

a negative plenum mounted on the side of the conveyor belt assembly opposite the positive plenum, with the conveyor belt assembly containing a plurality of apertures and defining one wall of a negative plenum; and blower means for moving air through the apertures in the positive plenum, then through the apertures in the conveyor belt assembly into and out of the negative plenum.

9. The machine according to claim 5 wherein the conveyor belt assembly and the plenum means curve upwardly from the exit of the heate means and extend over the heater means.

10. In a thermo-engraving machine of the type having deposition means for depositing a powder on wet ink of a freshly printed sheet, heater means for heating the sheets to melt the powder deposit, advancing means for continuously advancing the sheets from a printing machine through the heater means, an improved cooling conveyor means for cooling the sheets exiting the heater means, comprising in combination:

a conveyor belt assembly having a plurality of driven conveyor belt sections mounted end to end to define a path that extends upwardly from the heater means, then proceeds back over the heater means and terminates above a sheet tray;

a positive plenum having a discharge wall formed in the configuration of the path and closely spaced from the conveyor belt assembly, with one end located above the entrance of the conveyor belt assembly and another end below the conveyor belt assembly at the sheet tray, the discharge wall and the conveyor belt assembly having a plurality of apertures;

a negative plenum mounted on the side of the conveyor belt assembly opposite the positive plenum, with the conveyor belt assembly defining one wall of the plenum; and blower means for blowing air through the apertures in the positive plenum, then through the apertures in the conveyor belt assembly into and out of the negative plenum to cool the sheets and cause them to engage the conveyor belt assembly.

11. In a thermo-engraving machine of the type having deposition means for depositing a powder on wet ink of a freshly printed sheet, heater means for heating the sheets to melt the powder deposit, advancing means for continuously advancing the sheets from a printing machine through the heater means, an improved cooling conveyor means for cooling the sheets exiting the heater means, comprising in combination:

a driven conveyor belt assembly beginning at the exit of the heater means and turning back to terminate at a sheet tray in the vicinity of the entrance of the machine;

plenum means extending along the length of the conveyor belt assembly for passing air transversely through the conveyor belt assembly to cool the sheets and cause them to engage the conveyor belt assembly; and humidification means for adding moisture to the sheets as they proceed along the conveyor belt assembly.

12. The machine according to claim 11 wherein the humidification means comprises:

a tank containing a liquid mounted at the termination of the conveyor belt assembly; and roller means having one rotating roller in the liquid in the tank for transferring a film of liquid to the conveyor belt assembly.

13. In a thermo-engraving machine of the type having deposition means for depositing a powder on wet ink of a freshly printed sheet, heater means for heating the sheets to melt the powder deposit, advancing means for continuously advancing the sheets from a printing machine through the heater means, an improved cooling conveyor means for cooling the sheets exiting the heater means, comprising in combination:

a conveyor belt assembly having a plurality of driven conveyor belt sections mounted end to end to define a path that extends upwardly from the heater means, then proceeds back over the heater means and terminates above a sheet tray;

a tank containing a liquid mounted at the termination of the conveyor belt assembly; and roller means having one rotating roller in the liquid in the tank for transferring liquid to the conveyor belt assembly.

14. In a thermo-engraving machine of the type having deposition means for depositing a powder on wet ink of a freshly printed sheet, heater means for heating the sheets to melt the powder deposit, advancing means for continuously advancing the sheets from a printing machine through the heater means, an improved cooling conveyor means for cooling the sheets exiting the heater means, comprising in combination:

a conveyor belt assembly having a plurality of driven conveyor belt sections mounted end to end to define a path that extends upwardly from the heater means, then proceeds back over the heater means and terminates above a sheet tray;

the conveyor belt assembly having a roller located at the exit of the heater means over which a belt of the first conveyor belt section is drawn, the roller having a gear mounted to one end for engaging a gear of the advancing means for driving the first conveyor belt section, the end of the roller opposite the gear having a shaft that engages an open ended slot formed in a bracket mounted to the machine, enabling the conveyor belt assembly to be detached from the machine without tools by withdrawing the shaft from the slot and disengaging the gears.

15. The machine according to claim 14 further comprising a removable key that engages the bracket transverse to the slot for selectively retaining the shaft in the slot.

16. The machine according to claim 14 wherein the first conveyor belt section has a second roller opposite the roller located at the exit of the heater means, which comprises:

a drive member rotatably mounted to one side of the machine and having a free end;

a sleeve rotatably supported on the other side of the machine and having a free end; and engaging means for releasably engaging the free ends to cause the sleeve to rotate with the drive member.

17. In a thermo-engraving machine of the type that has advancing means for advancing freshly printed material from a printing machine along a path through a deposition means for depositing a powder on the wet ink, then through heater means for melting the powder, an improved means for depositing the powder, comprising:

division means for longitudinally dividing the deposition means into parallel segments that define separate containers for holding powder, enabling different types of powder to be placed on the material.

18. The machine according to claim 17 wherein the deposition means comprises a tank through which the material passes and the division means comprises:

at least one movable partition inserted in the tank parallel with the path, dividing the tank into at least two separate sections, each for containing powder.

19. In a thermo-engraving machine of the type that has advancing means for advancing freshly printed material from a printing machine along a path through a deposition means for depositing powder on the wet ink, then through heater means for melting the powder, the deposition means comprising:

a tank through which the material passes; and at least one vertical partition placed in the tank parallel with the path to divide the tank into at least two separate sections, enabling each section to contain a different type of powder; the lower edge of the partition being spaced above the bottom of the tank to enable the material to pass beneath the partition; the partition being movable to different lateral positions to vary the widths of the separate sections.

20. The machine according to claim 19 wherein the partitions are mounted on a transverse shaft.

21. The machine according to claim 19 wherein the deposition means further comprises:

vibration means located along the path after the tank and before the heater means in an area sloping upwardly from the tank for vibrating the material to shake powder from the portions not containing wet ink for allowing the powder shaken from the material to slide down the area to return to the tank.

22. The machine according to claim 21 wherein the deposition means further comprises:

suction means located along the path after the vibration means and before the heater means for removing from the non-wet ink portions of the material any traces of powder remaining after the vibration means.

23. In a thermo-engraving machine of the type that has advancing means for advancing freshly printed material from a printing machine along a path through a deposition means for depositing powder on the wet ink, then through heater means for melting the powder, the deposition means comprising in combination:

a cyclone powdering assembly of a type having feed means for feeding by gravity a metered stream of powder onto the path to cover the printed material with powder, the cyclone powdering assembly having recycling suction means for drawing from the path and printed material powder that has not contacted wet ink, the suction means including a nozzle mounted over the path and a fan located above the nozzle, the feed means and fan being mounted in a housing; and mounting means for pivotally mounting the housing to the machine and for selectively pivoting the housing including the feed means and the fan to an open position out of the path for cleaning.

24. The machine according to claim 23 wherein the housing separates from the nozzle when pivoted to the open position, leaving the nozzle mounted over the path.

25. The machine according to claim 24 further comprising:

a plurality of disks spaced apart from each other along a shaft extending across the nozzle, the disks being rotatable and adapted to contact the printed material on the path for preventing the printed material from being drawn into the nozzle as the printed material passes under the nozzle;

at least some of the disks having teeth extending around a circular periphery.

26. In a thermo-engraving machine of a type that has advancing means for advancing freshly printed material from a printing machine along a path through a deposition means for depositing powder on the wet ink, then through heater means for melting the powder, the deposition means comprising in combination:

a cyclone powdering assembly of a type that feeds by gravity a metered stream of powder onto the path to cover the printed material with powder, the cyclone powdering assemblyl having recycling suction means for drawing from the path and printed material powder that has not contacted wet ink;

the suction means having a suction nozzle extending across the path; and a plurality of disks mounted to a shaft within the nozzle, at least some of the disks having a toothed periphery, the disks being spaced-apart from each other and adapted to rotatably contact the printed material to prevent the printed material from being drawn into the suction means.

27. In a thermo-engraving machine of the type that has advancing means for advancing freshly printed material from a printing machine along a path through a deposition means for depositing powder on the wet ink, an improved heater means for melting the powder, comprising:

a housing mounted over the path having an entrance and exit for printed material to pass through;

the housing having longitudinal sidewalls extending upwardly above the path, defining a heat zone;

heat source means mounted in the housing for heating the heat zone; and width varying means for varying the distance between the sidewalls to vary width of the heat zone for printed material of different widths.

28. The machine according to claim 27 wherein the width varying means comprises:

a pair of longitudinal sidewalls carried by the housing; and slide means for moving at least one of the longitudinal sidewalls selectively toward and away from the other sidewall.

29. The machine according to claim 27 wherein the heat source means comprises a plurality of longitudinally extending heater elements mounted in the interior of the housing parallel with each other; and energizing means for selectively energizing the heater elements so that selected heater elements can be deenergized while others remain energized.

30. In a thermo-engraving machine of the type that has advancing means for advancing freshly printed material from a printing machine along a path through a deposition means for depositing powder on the wet ink, an improved heater means for melting the powder, comprising:

an insulated heat barrier mounted to the machine over the path, the barrier having an entrance and an exit for printed material to pass underneath the barrier;

a plurality of longitudinal and parallel heater elements mounted to the lower side of the barrier;

energizing means for selectively energizing the heater elements individually, so that selected heater elements can be deenergized while others are energized;

a pair of sidewalls carried longitudinally and parallel by the barrier, defining a heat zone; and slide means for selectively moving the sidewalls toward and away from each other to vary the width of the heat zone.

31. The machine according to claim 30 wherein the slide means comprises:

brackets secured to the ends of the sidewalls that depend from transverse braces mounted to the barrier at the entrance and exit, the brackets being slidable with respect to the braces.

32. The machine according to claim 30 wherein the barrier has an insulated side located on the exterior of each sidewall.

33. In a thermo-engraving machine of the type that has advancing means for advancing freshly printed material from a printing machine along a path through a deposition means for depositing powder on the wet ink, an improved heater means for melting the powder, comprising:

a housing mounted over the path, the housing having a top and longitudinal sides that define a heat zone within the housing, the housing having an entrance and exit for printed material to pass;

heat source means in the housing for heating the heat zone;

the housing being movable between a closed position in close proximity to the path and an open position spaced from the path; and safety release means for automatically moving the housing from the closed position to the open position should the advancing means cease moving the material.

34. The machine according to claim 33 further comprising:

width varying means for varying the distance between the sidewalls for varying the width of the heat zone for printed material of different widths.

35. In a thermo-engraving machine of the type that has advancing means for advancing freshly printed material from a printing machine along a path through a deposition means for depositing powder on the wet ink, an improved heater means for melting the powder, comprising:

a housing mounted over the path, the housing having a top and longitudinal sides that define a heat zone within the housing, the housing having an entrance and exit for printed material to pass;

heat source means in the housing for heating the heat zone;

the housing being movable between a closed position in close proximity to the path and an open position spaced from the path; and safety release means for automatically moving the housing from the closed position to the open position should the advancing means cease moving the material;

the safety release means comprising:

bias means for urging the housing to the open position;

latch means for releasably securing the housing in the closed position; and signal means for signaling the latch means to release the housing should the advancing means cease moving the material.

36. In a thermo-engraving machine of the type that has advancing means for advancing freshly printed material from a printing machine along a path through a deposition means for depositing powder on the wet ink, an improved heater means for melting the powder, comprising:

a housing mounted over the path, the housing having a top and longitudinal sides that define a heat zone within the housing, the housing having an entrance and exit for printed material to pass;

heat source means in the housing for heating the heat zone;

the housing being movable between a closed position in close proximity to the path and an open position spaced from the path; and safety release means for automatically moving the housing from the closed position to the open position should the advancing means cease moving the material;

the housing being pivotally secured to the machine at one end to pivot between the closed position in which the housing is horizontal, to the open position in which the housing inclines upwardly; and wherein the safety release means comprises:

bias means for urging the housing to pivot to the open position;

latch means for releasably securing the housing in the closed position; and signal means for maintaining the latch means in the closed position only when the signal means is energized.

37. In a thermo-engraving machine of the type that has advancing means for advancing freshly printed material from a printing machine along a path through a deposition means for depositing powder on the wet ink, an improved heater means for melting the powder, comprising:

a housing pivotally mounted over the path for movement between a closed position and an open position, the housing having a top and longitudinal sides that define a heat zone within the housing, the housing having an entrance and an exit for the printed material to pass;

heat source means in the housing for heating the heat zone;

bias means for urging the oven to the open position;

latch means movable between a locked position in which it retains the housing in the closed position to an unlocked position in which the housing moves to the open position, the latch means being biased to the unlocked position; and signal means for moving the latch means to the closed position when the signal means is energized.

38. The machine according to claim 37 wherein the signal means comprises an electrically actuated solenoid.

39. In a thermo-engraving machine of the type that has advancing means for advancing freshly printed material from a printing machine along a path through a deposition means for depositing powder on the wet ink, an improved heater means for melting the powder, comprising:

a housing mounted over the path, the housing having a top and longitudinal sides that define a heat zone within the housing, the housing having an entrance and exit for printed material to pass;

heat source means in the housing for heating the heat zone.

pivotal mounting means at one end of the housing for pivoting one end of the housing about an axis transverse to the path from a closed position in close proximity to the path to an open position spaced from the path;

bias means for urging the housing to the open position; and latch means for releasably securing the housing in the closed position.

* * * * *